US011211027B2

(12) United States Patent
Shang et al.

(10) Patent No.: US 11,211,027 B2
(45) Date of Patent: Dec. 28, 2021

(54) DRIVING CIRCUIT OF DISPLAY PANEL, DRIVING METHOD THEREOF, AND DISPLAY PANEL

(71) Applicant: BOE TECHNOLOGY GROUP CO., LTD., Beijing (CN)

(72) Inventors: Guangliang Shang, Beijing (CN); Liugang Zhou, Beijing (CN); Haoliang Zheng, Beijing (CN); Yaoqiu Jing, Beijing (CN); Mingfu Han, Beijing (CN); Seungwoo Han, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 760 days.

(21) Appl. No.: 16/084,027

(22) PCT Filed: Apr. 8, 2018

(86) PCT No.: PCT/CN2018/082178

§ 371 (c)(1),
(2) Date: Sep. 11, 2018

(87) PCT Pub. No.: WO2019/029174

PCT Pub. Date: Feb. 14, 2019

(65) Prior Publication Data

US 2021/0201840 A1 Jul. 1, 2021

(30) Foreign Application Priority Data

Aug. 7, 2017 (CN) ..... 201710665973.0

(51) Int. Cl.
*G09G 3/36* (2006.01)

(52) U.S. Cl.
CPC ..... *G09G 3/3696* (2013.01); *G09G 3/3655* (2013.01); *G09G 3/3677* (2013.01);
(Continued)

(58) Field of Classification Search
CPC ..... G09G 2340/0407–0421; G09G 2330/028; G09G 2310/0264
See application file for complete search history.

(56) References Cited

U.S. PATENT DOCUMENTS 8,786,990 B2 7/2014 Prabhu et al.
10,332,475 B2 * 6/2019 Huang ..... G09G 3/3648
(Continued)

FOREIGN PATENT DOCUMENTS

CN 102737590 A 10/2012
CN 103904882 A 7/2014
(Continued)

OTHER PUBLICATIONS

Extended (Supplementary) European Search Report dated Mar. 26, 2021, issued in counterpart EP Application No. 18755384 7. (38 pages).

(Continued)

*Primary Examiner* — Patrick F Marinelli
(74) *Attorney, Agent, or Firm* — Westerman, Hattori, Daniels & Adrian, LLP

(57) ABSTRACT

The present disclosure is related to a driving circuit of a display panel. The driving circuit may include a turn-on voltage adjusting circuit. The turn-on voltage adjusting circuit may include a control subcircuit and a switching and voltage division subcircuit. The switching and voltage division subcircuit may include a switching subcircuit and a basic voltage division subcircuit. The switching subcircuit may be configured to perform voltage division of a signal outputted by the output terminal of the control subcircuit to form a voltage division feedback signal of the corresponding resolution under control of the control signal and output the voltage division feedback signal to the voltage division feedback node.

19 Claims, 8 Drawing Sheets

(52) U.S. Cl.
CPC ..... *G09G 2310/0286* (2013.01); *G09G 2310/0289* (2013.01); *G09G 2320/0223* (2013.01); *G09G 2330/021* (2013.01); *G09G 2340/0407* (2013.01); *G09G 2340/0414* (2013.01); *G09G 2340/0421* (2013.01); *G09G 2340/0435* (2013.01)

(56) References Cited

U.S. PATENT DOCUMENTS

| | | | | |
|---|---|---|---|---|
| 10,621,928 | B2 * | 4/2020 | Huang | G02F 1/13454 |
| 10,896,655 | B2 * | 1/2021 | Kim | G09G 3/3685 |
| 2002/0027540 | A1 | 3/2002 | Lee | |
| 2011/0090212 | A1 * | 4/2011 | Han | G09G 3/3696 345/212 |
| 2014/0307010 | A1 | 10/2014 | Han | |
| 2017/0076657 | A1 | 3/2017 | Lu et al. | |
| 2017/0148420 | A1 * | 5/2017 | Gao | G09G 3/20 |
| 2018/0218707 | A1 * | 8/2018 | Huang | G09G 3/3648 |
| 2018/0268764 | A1 * | 9/2018 | Huang | G09G 3/3696 |
| 2019/0213971 | A1 * | 7/2019 | Kim | G09G 3/3696 |
| 2021/0056926 | A1 * | 2/2021 | Koo | G09G 3/2092 |

FOREIGN PATENT DOCUMENTS

| | | | |
|---|---|---|---|
| CN | 106128398 | A | 11/2016 |
| CN | 106157913 | A | 11/2016 |
| CN | 106782408 | A | 5/2017 |
| KR | 20160129157 | A | 11/2016 |

OTHER PUBLICATIONS

Office Action dated Jan. 2, 2020, issued in counterpart to CN Application No. 201710665973.0, with English translation (16 pages).

International Search Report dated Jul. 6, 2018, issued in counterpart International Application No. PCT/CN2018/082178 (10 pages).

* cited by examiner

DRIVING CIRCUIT OF DISPLAY PANEL, DRIVING METHOD THEREOF, AND DISPLAY PANEL

CROSS-REFERENCE TO RELATED APPLICATIONS

This application claims benefit of the filing date of Chinese Patent Application No. 201710665973.0 filed on Aug. 7, 2017, the disclosure of which is hereby incorporated by reference.

TECHNICAL FIELD

This invention relates to a display technology, and more particularly, to a driving circuit of a display panel, a driving method thereof, and a display panel.

BACKGROUND

At present, display technology is widely used in televisions, mobile phones and public information displays. Flat-panel displays for displaying images are greatly promoted because of their slim and energy-saving features. With continuous development of communication industry, function of display products is becoming more and more powerful. It has evolved from original single display function to multiple integrated functions of voice, data, image, music and multimedia. As the functions of the display product becomes more and more powerful, power consumption of the display products is also growing. Therefore, reducing the power consumption of display products, thereby enhancing market competitiveness of the display products, has become a development trend of the display products.

BRIEF SUMMARY

Accordingly, one example of the present disclosure is a driving circuit of a display panel. The driving circuit of the display panel may include a turn-on voltage adjusting circuit. The turn-on voltage adjusting circuit may include a control subcircuit and a switching and voltage division subcircuit. The switching and voltage division subcircuit may include a switching subcircuit and a basic voltage division subcircuit.

The switching subcircuit may include a control terminal, a first input terminal, a second input terminal, and an output terminal. The control terminal of the switching subcircuit may be configured to input a control signal of a corresponding resolution, the first input terminal thereof may be electrically connected with an output terminal of the control subcircuit, the second input terminal may be configured to access a ground power supply signal, and the output terminal thereof may be electrically connected with a voltage division feedback node. The switching subcircuit may be configured to perform voltage division of a signal outputted by the output terminal of the control subcircuit to form a voltage division feedback signal of the corresponding resolution under control of the control signal and output the voltage division feedback signal to the voltage division feedback node.

The control subcircuit may include a first input terminal, a second input terminal and the output terminal. The first input terminal of the control subcircuit may be electrically connected with the voltage division feedback node, the second input terminal thereof may be configured to input an initial level signal, and the output terminal thereof may be electrically connected with the first input terminal of the switching and voltage division subcircuit and be configured to output an turn-on voltage signal of the corresponding resolution.

The driving circuit of the display panel may further include a plurality of cascaded shift registers. The turn-on voltage adjusting circuit may be configured to adjust the initial level signal for turning on a pixel switch to a turn-on voltage signal matching a present resolution of the display panel, and output the turn-on voltage signal to a reference level signal terminal of each of the plurality of the cascaded shift registers. Each of the plurality of the cascaded shift registers may be configured to input a scan signal corresponding to the present resolution of the display panel to a correspondingly connected gate line based on the turn-on voltage signal at the reference level signal terminal in case that the display panel performs a driving scan.

The switching subcircuit may include a third resistor, a fourth resistor, a first switching transistor, and a second switching transistor. One terminal of the third resistor may be electrically connected with one terminal of the fourth resistor and configured to access the signal outputted by the output terminal of the control subcircuit. The other terminal of the third resistor may be electrically connected with a source electrode of the first switching transistor. A gate electrode of the first switching transistor may be respectively electrically connected with the other terminal of the fourth resistor and a drain electrode of the second switching transistor. A drain electrode of the first switching transistor may be electrically connected with the voltage division feedback node. A gate of the second switching transistor may be configured to input the control signal of the corresponding resolution, and a source of the second switching transistor may be configured to access the ground power supply signal.

The switching subcircuit may include a first voltage division resistor and a fifth switching transistor. One terminal of the first voltage division resistor may be configured to access the signal outputted by the output terminal of the control subcircuit. The other terminal thereof may be electrically connected with a source electrode of the fifth switching transistor. A gate electrode of the fifth switching transistor may be configured to input the control signal of the corresponding resolution, and a drain electrode thereof is electrically connected with the voltage division feedback node.

The basic voltage division subcircuit may include a first resistor and a second resistor. One terminal of the first resistor may be configured to access the signal outputted by the output terminal of the control subcircuit, and the other terminal thereof may be electrically connected with the voltage division feedback node. One terminal of the second resistor may be electrically connected with the voltage division feedback node, and the other terminal thereof may be configured to access the ground power supply signal.

The control subcircuit may include a voltage division feedback processing subcircuit and a voltage regulation subcircuit. A first control terminal of the voltage division feedback processing subcircuit may be configured to input a pulse control signal, a second control terminal thereof may be configured to input a reference signal, a first input terminal thereof may be configured to input the initial level signal, a second input terminal thereof may be electrically connected with the voltage division feedback node, an output terminal thereof may be electrically connected with an input terminal of the voltage regulation subcircuit. Under control of the pulse control signal, the reference signal, and the voltage division feedback signal, the voltage division feedback processing subcircuit may be configured to perform feedback of the initial level signal to form a corresponding coupling charging signal and output the corresponding coupling charging signal to the first input terminal of the voltage regulation subcircuit.

A second input terminal of the voltage regulation subcircuit may be configured to input the initial level signal, an output terminal thereof may be configured to output the turn-on voltage signal after voltage regulation; and the voltage regulation subcircuit may be configured to perform voltage regulation of the initial level signal based on the coupling charging signal to form the turn-on voltage signal of the corresponding resolution and output the turn-on voltage signal.

The turn-on voltage adjusting circuit may include a plurality of switching subcircuits. Each of the plurality of switching subcircuits may correspond to a different resolution.

The driving circuit of the display panel may further include a common voltage adjusting circuit. The common voltage adjusting circuit may be configured to adjust a power supply signal for providing a common voltage to a common voltage signal matching the corresponding resolution of the display panel and output the common voltage signal. The common voltage adjusting circuit may include a common voltage switching subcircuit. A control terminal of the common voltage switching subcircuit may be configured to input a switching control signal corresponding to the present resolution, a first input terminal thereof may be configured to access the power supply signal, a second input terminal thereof may be configured to connect with the ground power supply signal, an output terminal thereof may be configured to output the common voltage signal of the corresponding resolution. Under control of the switching control signal, the common voltage switching subcircuit may be configured to adjust the power supply signal to the common voltage signal of the corresponding resolution and output the common voltage signal.

The common voltage switching subcircuit may include a seventh resistor, an eighth resistor, a third switching transistor, and a fourth switching transistor. One terminal of the seventh resistor may be configured to access the power supply signal and the other terminal thereof is electrically connected with a source electrode of the third switching transistor. A gate electrode of the third switching transistor may be respectively electrically connected with one terminal of the eighth resistor and a drain electrode of the fourth switching transistor. A drain electrode thereof may be configured to output the common voltage signal of the corresponding resolution. The other terminal of the eighth resistor may be configured to access the power supply signal. A gate electrode of the fourth switching transistor may be configured to input the switching control signal of the corresponding resolution, and a source electrode thereof is electrically connected with the ground power supply signal.

The common voltage switching subcircuit may include a second division resistor and a sixteenth switching transistor. The second voltage division resistor may be configured to access the power supply signal. The other terminal thereof may be electrically connected with a source electrode of the sixteenth switching transistor. A gate electrode of the sixteenth switching transistor may be configured to input the switching control signal of the corresponding resolution. A drain electrode thereof may be configured to output the common voltage signal of the corresponding resolution.

The common voltage adjusting circuit may further include an initial voltage subcircuit. A first input terminal of the initial voltage subcircuit may be configured to access the power supply signal, a second input terminal thereof may be electrically connected with the around power supply signal, and an output terminal thereof may be configured to output the common voltage signal of the corresponding resolution. The initial voltage subcircuit may be configured to perform voltage division of the power supply signal and output the common voltage signal of the corresponding resolution.

The initial voltage subcircuit may include a fifteenth resistor and a sixteenth resistor. A first terminal of the fifteenth resistor may be configured to access the power supply signal, the other terminal thereof may be electrically connected with one terminal of the sixteenth resistor and configured to output the common voltage signal of the corresponding resolution, and the other terminal of the sixteenth resistor may be configured to access the ground power supply signal.

The common voltage adjusting circuit may further include an output subcircuit. A first input terminal of the output subcircuit may be respectively electrically connected with the output terminal of the common voltage switching subcircuit and the output terminal of the initial voltage subcircuit, and the second input terminal thereof may be electrically connected with the output terminal thereof. The output subcircuit may be configured to perform current amplification of the common voltage signal outputted by the common voltage switching subcircuit and the initial voltage subcircuit and then output an amplified common voltage signal.

The output subcircuit may include an operational amplifier. A first input terminal of the operational amplifier may be electrically connected with the output terminal of the initial voltage subcircuit and the output terminal of the common voltage switching subcircuit respectively, and a second input terminal thereof may be electrically connected with the output terminal thereof. The common voltage adjusting circuit may include a plurality of common voltage switching subcircuits. Each of the common voltage switching subcircuits may correspond to a different resolution.

Another example of the present disclosure is a display panel. The display panel may include the driving circuit according to one embodiment of the present disclosure. Shifting registers and the voltage adjusting circuit may be located at peripheral area of the display panel.

Another example of the present disclosure is a driving method for the driving circuit. The driving method may include providing the initial level signal to the second input terminal of the control subcircuit and providing the control signal of the corresponding resolution of the display panel to the switching subcircuit so that the turn-on voltage signal matching the corresponding resolution of the display panel may be outputted from the turn-on voltage adjusting circuit to a reference level signal terminal of each of shift registers.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

Figure 1A:
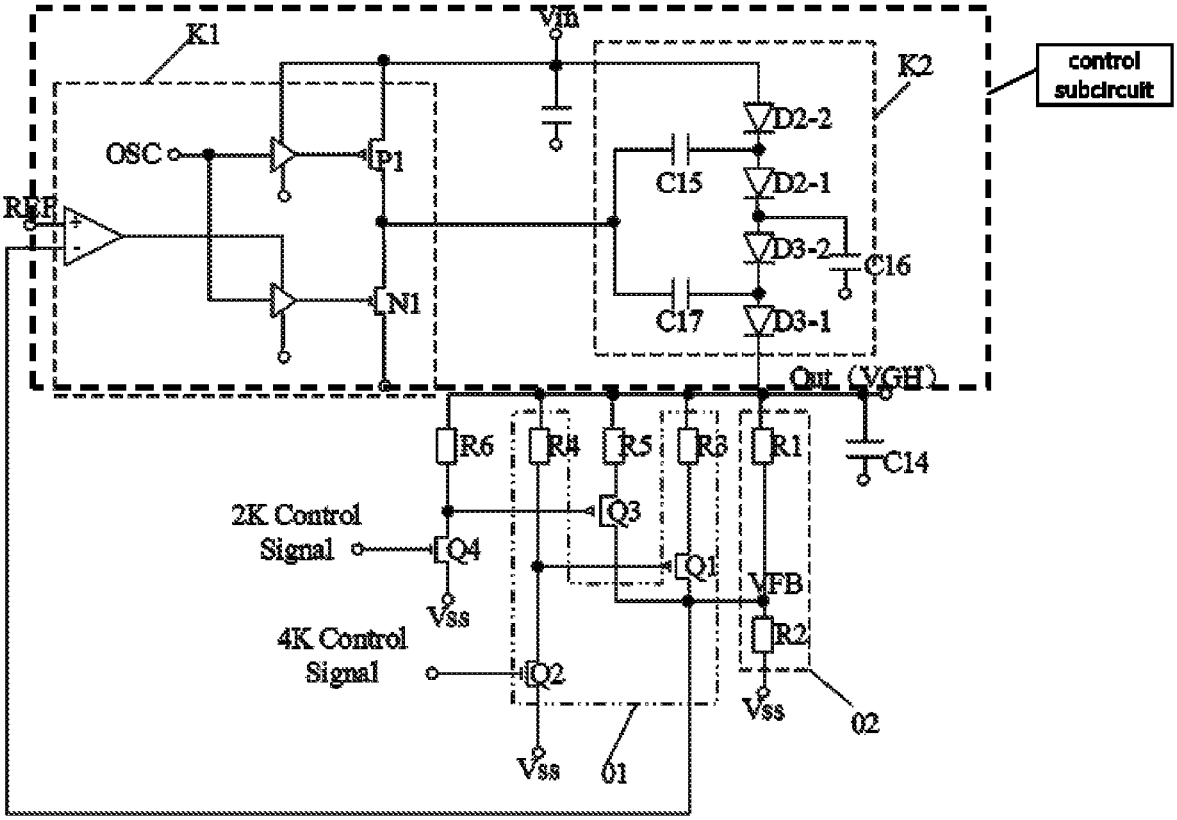
FIG. 1*a* is a schematic circuit diagram of a turn-on voltage adjusting circuit according to one embodiment of the present disclosure.

The present disclosure will be described in further detail with reference to the accompanying drawings and embodiments in order to provide a better understanding by those skilled in the art of the technical solutions of the present disclosure. Throughout the description of the disclosure, reference is made to FIGS. 1-5. When referring to the figures, like structures and elements shown throughout are indicated with like reference numerals.

The transistors in embodiments of the present disclosure are thin film transistors, field effect transistors or other apparatus with the same characteristics. The transistors in embodiments of the present disclosure are mainly switch transistors based on their function in the circuit. Because a source electrode and a drain electrode of the switch transistor are symmetric, the source electrode and the drain electrode thereof are interchangeable in embodiments of the present disclosure.

In addition, in the description of the specification, the terms "first" and "second" are for illustration purposes only and are not to be construed as indicating or implying relative importance or implied reference to the quantity of indicated technical features. Thus, features defined by the terms "first" and "second" may explicitly or implicitly include one or more of the features. In the description of the present disclosure, the meaning of "plural" is two or more unless otherwise specifically and specifically defined.

In the description of the specification, references made to the term "one embodiment," "some embodiments," and "exemplary embodiments," "example," and "specific example," or "some examples" and the like are intended to refer that specific features and structures, materials or characteristics described in connection with the embodiment or example that are included in at least one embodiment or example of the present disclosure. The schematic expression of the terms does not necessarily refer to the same embodiment or example. Moreover, the specific features, structures, materials or characteristics described may be included in any suitable manner in any one or more embodiments or examples.

Each section of a display screen usually displays an image according to its physical resolution. However, in mobile display application such as mobile phones, in order to extend battery life, the display resolution can be properly reduced, thereby reducing display and system power consumption.

One example of the present disclosure is a driving circuit for a display panel. The driving circuit comprises a turn-on voltage adjusting circuit and a plurality of cascaded shift registers.

According to a present resolution of a display panel being switched to, the turn-on voltage adjusting circuit is used for adjusting an initial level signal for turning on a pixel switch to a turn-on voltage signal matching the present resolution of the display panel and outputting the turn-on voltage signal to a reference level signal terminal of each of the shift registers. According to the signal of the reference level signal terminal, each of the shift registers is used for inputting a scan signal corresponding to the present resolution of the display panel to a correspondingly connected gate line when the display panel performs a driving scan.

By including the turn-on voltage adjusting circuit in the driving circuit as mentioned above, when the display panel is switched to a different display resolution, the turn-on voltage of the pixel switch is adjusted so that driving voltages for the shift registers are reduced, thereby reducing power consumption of the shift registers. Because the shift registers use mainly dynamic power consumption, related factors are shown as in following formula (1):

$$P \propto f\,CV^2$$

Wherein f is a charging and discharging frequency of a clock signal CLK in the shift registers. Reducing the frequency can cause a problem of losing data. C is a load capacitance of the CLK, which cannot be changed after structural design of the shift registers is set. V is amplitude of CLK voltage change, namely VGH-VGL. Thus, power consumption reduction can be achieved by adjusting the VGH, and the energy-saving effect is relatively obvious. When the resolution of the display panel is switched to a lower one, the charging time for the pixels is prolonged so that the charging current can be reduced. That is, when satisfying a same charging rate as a reference, a turn-on voltage of a pixel switch, that is, a voltage of scan signals outputted by the shifting registers, is properly reduced so as to reduce power consumption of the shifting registers as well as the display panel.

Figure 1B:
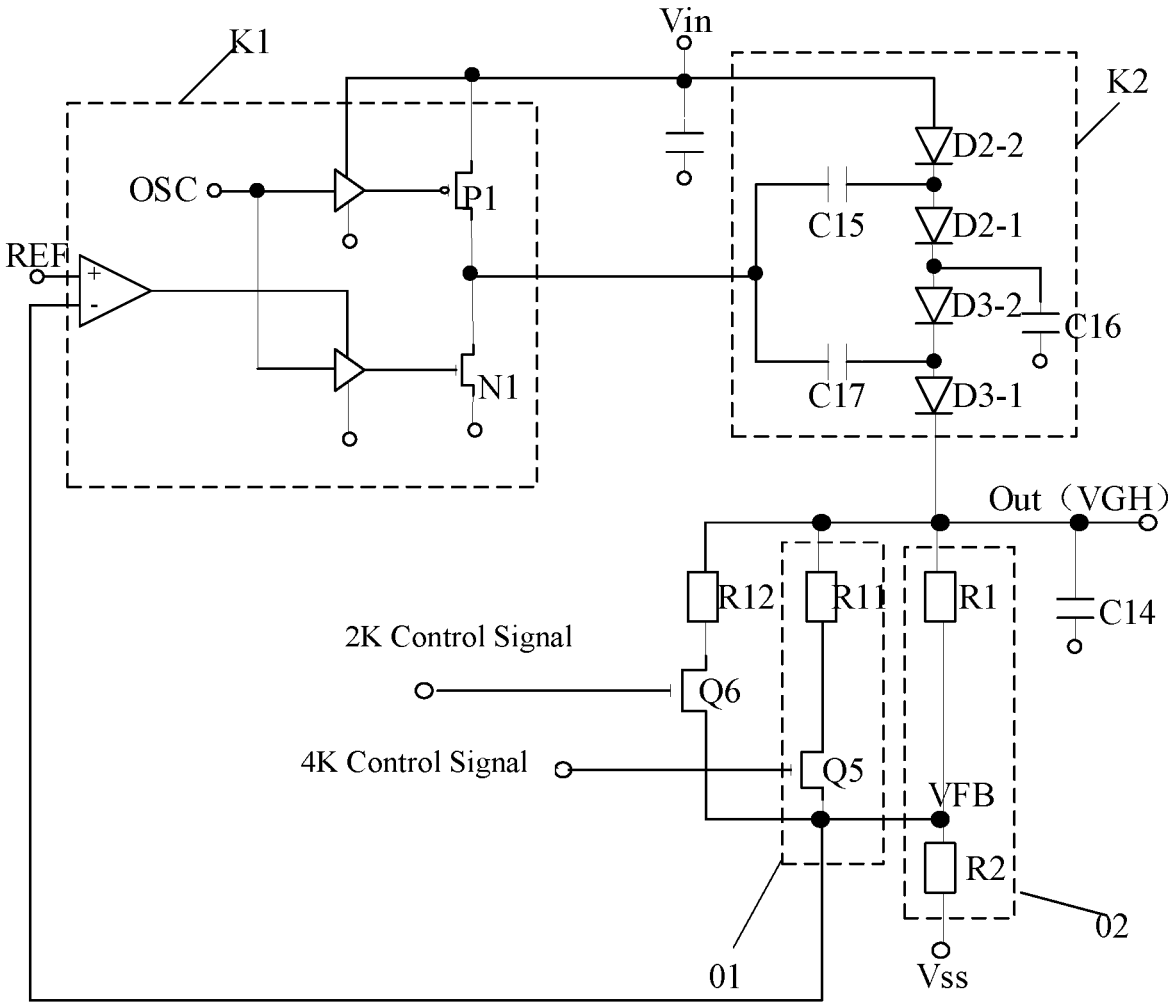
FIG. 1*b* is a schematic circuit diagram of a turn-on voltage adjusting circuit according to one embodiment of the present disclosure.

In one embodiment, as shown in FIG. 1*a* and FIG. 1*b*, in the driving circuit, the turn-on voltage adjusting circuit comprises a turn-on voltage adjusting circuit. The turn-on voltage adjusting circuit includes a control subcircuit and a switching and voltage division subcircuit. The control circuit includes a voltage division feedback processing subcircuit K1, a voltage regulation subcircuit K2. The switching and voltage division subcircuit includes a switching subcircuit 01. A control terminal of the switching subcircuit 01 is used for inputting a control signal of a corresponding resolution. The control signal can turn on a corresponding switching transistor when the resolution of the display panel is switched to a different one such as 2K or 4K. A first input terminal thereof is used for accessing an initial level signal VIN. A second input terminal thereof is used for accessing a ground power supply signal VSS. An output terminal thereof is electrically connected with a voltage division feedback node VFB. The switching subcircuit 01 is used for performing voltage division of the initial level signal, Vin, under control of the control signal to form a voltage division feedback signal of a corresponding resolution and outputting the voltage division feedback signal to the voltage division feedback node VFB.

In one embodiment, a first control terminal of the voltage division feedback processing subcircuit K1 is used for inputting a pulse control signal OSC. A second control terminal thereof is used for inputting a reference signal REF. A first input terminal thereof is used for inputting the initial level signal Vin. A second input terminal thereof is electrically connected with the voltage division feedback node VFB. An output terminal thereof is electrically connected with a first input terminal of the voltage regulation subcircuit K2. Under control of the pulse control signal OSC, the reference signal REF, and the voltage division feedback signal, the voltage division feedback processing subcircuit K1 is used for performing voltage division and feedback of the initial level signal Vin to form a corresponding coupling charging signal DRVP and outputting the corresponding coupling charging signal DRVP to the first input terminal of the voltage regulation subcircuit K2.

In one embodiment, a second input terminal of the voltage regulation subcircuit K2 is used for inputting the initial level signal Vin. An output terminal thereof is used for outputting a regulated turn-on voltage signal VGH. The voltage regulation subcircuit K2 is used for performing voltage regulation of the initial level signal Vin according to the coupling charging signal DRVP to form the turn-on voltage signal of the corresponding resolution, VGH, and outputting the VGH.

In one embodiment, the voltage division feedback processing subcircuit K1 and the voltage regulation subcircuit K2 have circuit structures as shown in FIGS. 1*a* and 1*b*. An output terminal OUT is used for outputting the turn-on voltage signal VGH of the corresponding resolution. The turn-on voltage signal VGH is determined by the voltage signal of the voltage division feedback node VFB. A comparison result of the voltage signal of the voltage division feedback node VFB and the reference signal REF determines whether transistor N1 is turned on, thereby affecting whether the coupling charging voltage DRVP couples to capacitors C15 and C17 to charge the output terminal OUT and accordingly determining the regulated voltage of the turn-on voltage signal VGH.

Figure 1C:
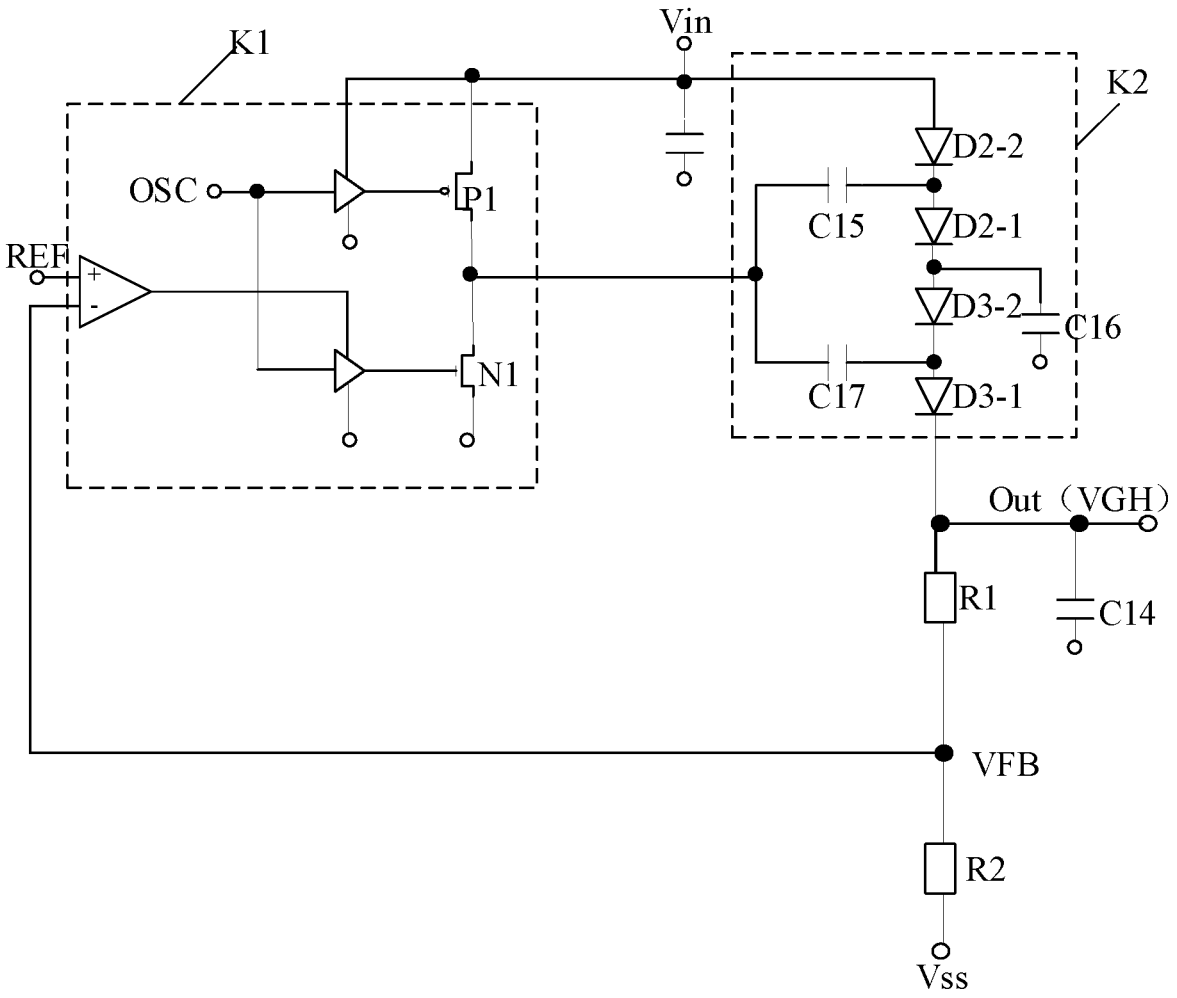
FIG. 1*c* is a schematic circuit diagram of a turn-on voltage adjusting circuit according to one embodiment of the present disclosure.

In one embodiment, as shown in FIG. 1*c*, when a circuit structure used for voltage division in the turn-on voltage adjusting circuit comprises only resistors R1 and R2, the turn-on voltage signal VGH=1.2*(1+R1/R2). The coefficient 1.2 may be adjusted correspondingly based on parameters of each of components actually used in the circuit. When the circuit structure used for voltage division is as shown in FIG. 1*a* or FIG. 1*b*, and when a resolution of a display panel is switched, calculation of voltage division with R1 and R2 in the above calculation formula should be changed to be based on voltage division between R1 connected in parallel with another resistor and R2. For example, in the circuit structure as shown in FIG. 1*a*, when the display panel is switched to 4 k resolution, a voltage division of R1 and R2 in the calculation formula should be changed to a voltage division of R1 and R3 connected in parallel and then R2. Since the circuit structures and the functions of the voltage division feedback processing subcircuit and the voltage regulation subcircuit are similar as those in the prior art, they are not described in detail here. In the driving circuit according to one embodiment of the present disclosure, the voltage signal of the voltage division feedback node VFB is adjusted through voltage division function of the switching subcircuit. Then, through the voltage division feedback processing subcircuit and the voltage regulation subcircuit, the final output terminal OUT outputs a regulated turn-on voltage signal VGH of a corresponding resolution which matches the resolution of the present display panel, thereby reducing power consumption.

In one embodiment, as shown in FIGS. 1*a* and 1*b*, in the driving circuit, the turn-on voltage adjusting circuit may further comprise a basic voltage division subcircuit 02. A first input terminal of the basic voltage division subcircuit 02 is used for accessing the initial level signal Vin. A second input terminal thereof is electrically connected with the ground power supply signal VSS. An output terminal thereof is electrically connected with the voltage division feedback node VFB. The basic voltage division subcircuit 02 is used for performing voltage division of the initial level signal Vin and outputting the voltage division feedback signal of a corresponding resolution. In one embodiment, the basic voltage division subcircuit 02 may include a first resistor R1 and a second resistor R2. One terminal of the first resistor R1 is used for accessing Ire initial level signal Vin. The other terminal thereof is electrically connected with the voltage division feedback node VFB. One terminal of the second resistor R2 is electrically connected with the voltage division feedback node VFB. The other terminal of the second resistor R2 is electrically connected with the ground power supply signal VSS.

In one embodiment, as shown in FIG. 1*a*, in the driving circuit, the switching subcircuit may comprise a third resistor R3 and a fourth resistor R4, a first switching transistor Q1 and a second switching transistor Q2. One terminal of the third resistor R3 is electrically connected with one terminal of the fourth resistor R4 and is used for accessing the initial level signal VGH. The other terminal of the third resistor R3 is electrically connected with a source electrode of the first switching transistor Q1. A gate electrode of the first switching transistor Q1 is electrically connected with the other terminal of the fourth resistor R4 and a drain electrode of the second switching transistor Q2 respectively. A drain electrode of the first switching transistor Q1 is electrically connected with the voltage division feedback node VFB. The gate electrode of the second switching transistor Q2 is used for inputting a control signal of a corresponding resolution. A source electrode thereof is electrically connected with the ground power supply signal VSS.

In one embodiment, as shown in FIG. 1*b*, in the driving circuit, the switching subcircuit may comprise a first voltage division resistor R11 and a fifth switching transistor Q5. One terminal of the first voltage division resistor R11 is used for accessing the initial level signal VGH. The other terminal thereof is electrically connected with a source electrode of the fifth switching transistor Q5. A gate electrode of the fifth switching transistor Q5 is used for inputting a control signal of a corresponding resolution. A drain electrode thereof is electrically connected with the voltage division feedback node VFB.

As mentioned above, the switching subcircuit in FIG. 1*a* includes two transistors and two resistors. The switching subcircuit in FIG. 1*b* includes one transistor and one resistor. FIG. 1*a* is suitable for a situation that the voltage value of the control signal of the corresponding resolution is small. FIG. 1*b* is suitable for a situation that the voltage value of the control signal of the corresponding resolution is large. The reasons are as follows: as shown in FIG. 1*b*, the 4 k control signal is directly electrically connected with the gate electrode of Q5. When the 4 k control signal is sent out by the integrated circuit, the integrated circuit sends out a logic level. The maximum voltage value corresponding to the logic level 1 can be 5V. The source electrode of Q5 is electrically connected with the VGH through R11, and the VGH is usually larger than 5V. Accordingly, Q5 is always kept turned off, and the circuit does not work. Therefore, the gate electrode of Q5 needs to be electrically connected with a signal of a larger voltage.

In one embodiment, in a driving circuit, the turn-on voltage adjusting circuit may comprise a plurality of switching subcircuits. Each switching subcircuit corresponds to a different resolution. Both FIG. 1*a* and FIG. 1*b* are illustrated by using two switching subcircuits as an example. In actual application, a display panel may switch to a plurality of resolutions according to actual need. Accordingly, a number of switching subcircuits may be provided and the number is not limited herein.

Taking the circuit structure of the voltage adjusting circuit as shown in FIG. 1*a* as an example, when a resolution of a display panel is switched, the driving circuit according to one embodiment of the present disclosure can output a turn-on voltage signal of the corresponding resolution. More details are discussed as follows:

In one embodiment, when both a 2K control signal and a 4K control signal are at low levels, switching transistors Q4 and Q2 are off. Meanwhile, switching transistors Q3 and Q1 are also off. The initial level signal Vin controls the voltage signal of the voltage division feedback node VFB through resistors R1 and R2 connecting in series for voltage division. Then, under operation of the voltage divisor feedback processing subcircuit and the voltage regulation subcircuit, a required turn-on voltage signal VGH (VGH_8 k) corresponding to 8K resolution is outputted.

In one embodiment, when the 2K control signal is at a low level and the 4 k control signal is at a high level, the switching transistors Q4 and Q3 are turned off and the switching transistors Q2 and Q1 are turned on. R1 is connected in parallel with R3. The initial level signal VGH controls the voltage signal of the voltage division feedback node VFB through resistors R1 and R3 connected in parallel and then resistor R2 for voltage division. Then, under operation of the voltage division feedback processing subcircuit K1 and the voltage regulation subcircuit K2, a required turn-on voltage signal VGH (VGH_4 k) corresponding to 4 k resolution is outputted.

In one embodiment, when the 4K control signal is at a low level, and the 2K control signal is at a high level, the switching transistors Q1 and Q2 are turned off, and the switching transistors Q3 and Q4 are turned on. R1 is electrically connected with R5 in parallel. The initial level signal VGH controls the voltage signal of the voltage division feedback node VFB through resistors R1 and R5 connected in parallel and then resistor R2 for voltage division. Then, under operation of the voltage division feedback processing subcircuit K1 and the voltage regulation subcircuit K2, a required turn-on voltage VGH (VGH_2K) corresponding to 2K resolution is outputted.

In the driving circuit according to one embodiment of the present disclosure, dynamic real-time adjustment of the turn-on voltage signal VGH can be realized with operations of the resistors, the switching transistors and other components. In one embodiment, the 2K control signal and the 4 k control signal may be provided by a display system or a timing controller (TCON). A voltage relation is VGH_8K>VGH_4 k>VGH_2K. As such, when the resolution is reduced, power consumption of the shift registers can be reduced. The amplitudes of resistors R1, R2, R3, R4 and R5, R6 may be determined based on voltage requirement of the display panel for the VGHs, and are not limited herein.

In one embodiment, after the display panel charges the pixels, a pixel holding voltage can be affected by a coupling voltage of pixels. A relationship between dVp, an amount of deviation of the pixel voltage, and the VGH is shown in below formula (2):

$$dVp = \frac{C_{gs}}{C_{st} + C_{LC} + C_{gd} + C_{gs}} \cdot (VGH - VGL)$$

$C_{gs}$, $C_{gd}$, $C_{LC}$, $C_{st}$ are a parasitic capacitance between a gate electrode and a source electrode of a pixel switching transistor, a parasitic capacitance between a gate electrode and a drain electrode of the pixel switching transistor, a pixel liquid crystal capacitance, and a pixel storage capacitance in the display panel respectively.

Figure 2:
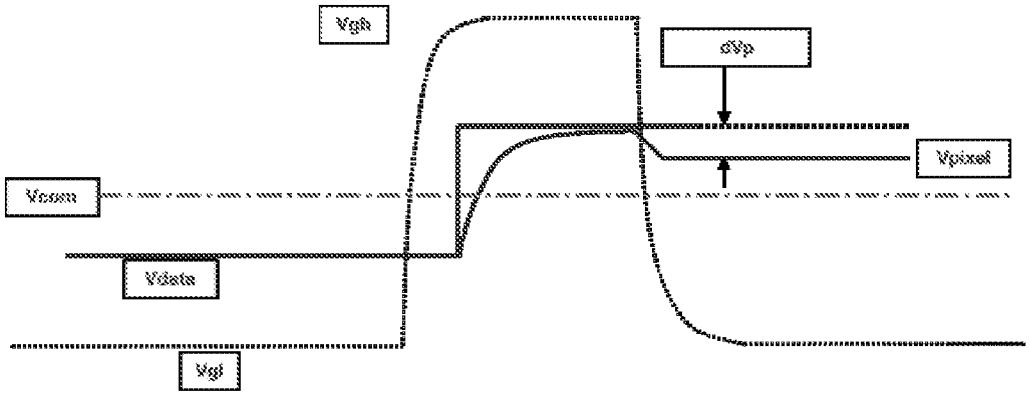
FIG. 2 is a schematic waveform diagram of a pixel voltage under an influence of a coupling voltage according to one embodiment of the present disclosure.

FIG. 2 is a schematic waveform diagram of a pixel voltage under influence of the coupling voltage according to one embodiment of the present disclosure. As shown in FIG. 2, when a scan signal Gate is closed, a pixel voltage $V_{pixel}$ is affected by the coupling capacitance $C_{gs}$ to deviate. The amount of the deviation, dVp, is determined according to the above formula (2). In order to ensure normal display brightness of a display panel, it is necessary to lower down the common voltage Vcom in the amount of dVp as well, thereby ensuring that a voltage on a liquid crystal layer in the display panel is at a target voltage. Therefore, in order to reduce power consumption of a display panel when switching between different resolutions, the turn-on voltage adjusting circuit adjusts the turn-on voltage signal VGH, and as can be seen from formula (2), dVp also changes correspondingly. As such, the common voltage Vcom also needs to be adjusted so as to ensure the voltage on the liquid crystal layer in the display panel is at the target voltage.

In one embodiment, the driving circuit may further comprise a common voltage adjusting circuit. Based on the present resolution of the display panel being switched to, the common voltage adjusting circuit is used for adjusting a power supply signal for providing a common voltage to a common voltage signal matching the present resolution of the display panel and outputting the common voltage signal.

Figure 3A:
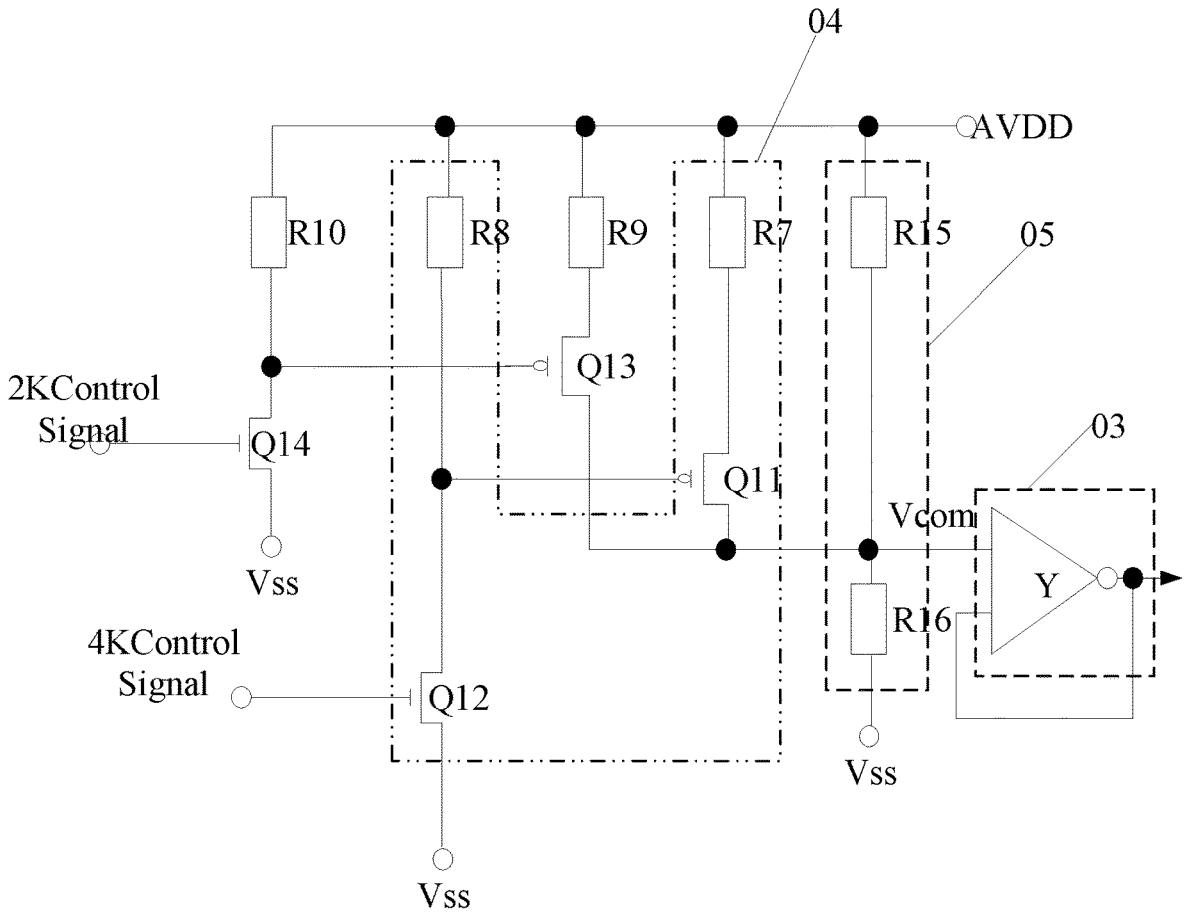
FIG. 3*a* is a schematic circuit diagram of a common voltage adjusting circuit according to one embodiment of the present disclosure.
Figure 3B:
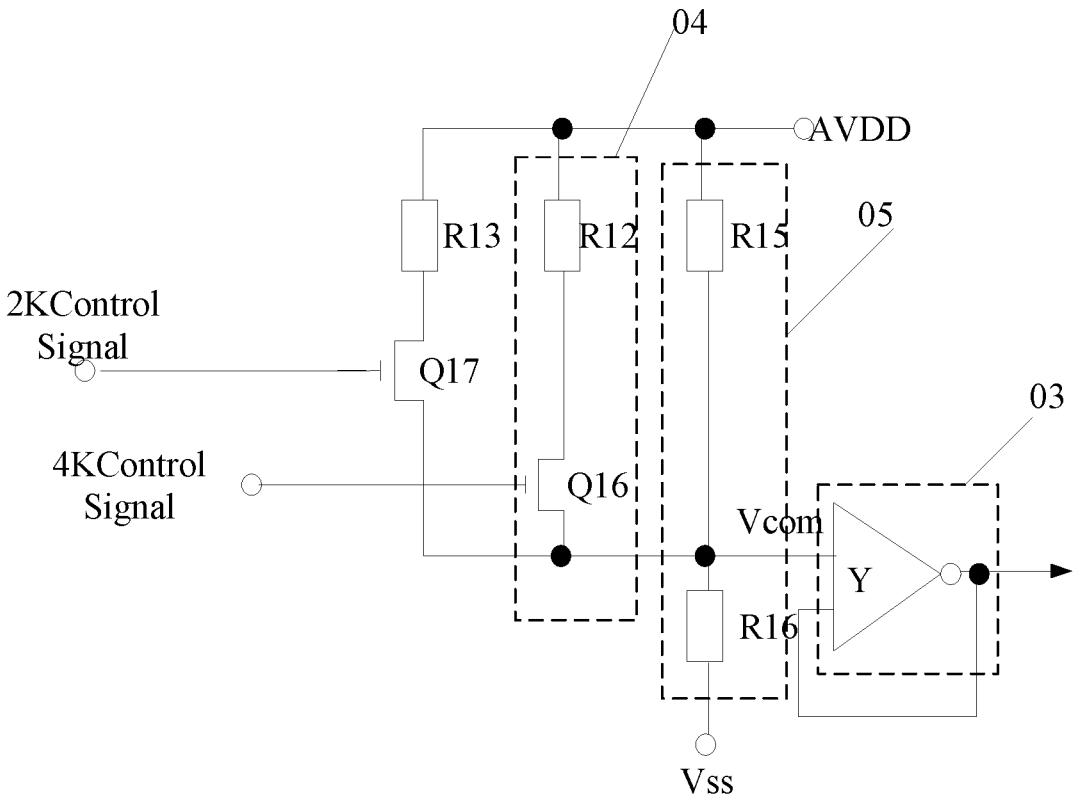
FIG. 3*b* is a schematic circuit diagram of a common voltage adjusting circuit according to one embodiment of the present disclosure.

In a driving circuit according to one embodiment of the present disclosure, as shown in FIG. 3*a* and FIG. 3*b*, the common voltage adjusting circuit may comprise a common voltage switching subcircuit 04. A control terminal of the common voltage switching subcircuit 04 is used for inputting a control signal of a corresponding resolution. The control signal refers to one which is used to turn on the corresponding switching transistor when a display panel is switched to a different resolution such as 2 k or 4 k. A first input terminal of the common voltage switching subcircuit 04 is used for accessing a power supply signal AVDD. A second input terminal thereof is used for accessing a ground power supply signal VSS. An output terminal thereof is used for outputting a common voltage signal Vcom of a corresponding resolution. Under control of the switching control signal, the common voltage switching subcircuit 04 is used for adjusting a power supply signal AVDD to be a common voltage signal Vcom of a corresponding resolution and outputting the common voltage signal Vcom.

In a driving circuit according to one embodiment of the present disclosure, as shown in FIG. 3*a* and FIG. 3*b*, the common voltage adjusting circuit may further comprise an initial voltage subcircuit 05. A first input terminal of the initial voltage subcircuit 05 is used for accessing the power supply signal AVDD. A second input terminal thereof is electrically connected with the ground power supply signal VSS. An output terminal thereof is used for outputting a common voltage signal Vcom of a corresponding resolution. The initial voltage subcircuit 05 is used for performing voltage division of the power supply signal AVDD and accordingly outputting a common voltage signal Vcom of a corresponding resolution.

In one embodiment, the initial voltage subcircuit 05 comprises a fifteenth resistor R15 and a sixteenth resistor R16. One terminal of the fifteenth resistor R15 is used for accessing the power supply signal AVDD. The other terminal thereof is electrically connected with one terminal of the sixteenth resistor R16 and is used for outputting the common voltage signal Vcom of the corresponding resolution. The other terminal of the sixteenth resistor R16 is electrically connected with the ground power supply signal VSS.

In a driving circuit according to one embodiment of the present disclosure, as shown in FIG. 3*a*, the common voltage switching subcircuit may comprise a seventh resistor R7, an eighth resistor R8, a third switching transistor Q11 and a fourth switching transistor Q12. One terminal of the seventh resistor R7 is used for accessing the power supply signal AVDD. The other terminal thereof is electrically connected with a source electrode of the third switching transistor Q11. A gate electrode of the third switching transistor Q11 is electrically connected with one terminal of the eighth resistor R8 and a drain electrode of the fourth switching transistor Q12 respectively. A drain electrode thereof is used for outputting a common voltage signal Vcom of a corresponding resolution. The other terminal of the eighth resistor R8 is used for accessing the power supply signal AVDD. A gate electrode of the fourth switching transistor Q12 is used for inputting a switching control signal of a corresponding resolution. A source electrode thereof is electrically connected with the ground power supply signal VSS.

In a driving circuit according to one embodiment of the present disclosure, as shown in FIG. 3*b*, the common voltage switching subcircuit may comprise a second voltage division resistor R12 and a sixteenth switching transistor Q16. One terminal of the second voltage division resistor R12 is used for accessing the power supply signal AVDD. The other terminal thereof is electrically connected with a source electrode of the sixteenth switching transistor Q16. A gate electrode of the sixteenth switching transistor Q16 is used for inputting a switching control signal of a corresponding resolution. A drain electrode thereof is used for outputting a common voltage signal of the corresponding resolution.

In a driving circuit according to one embodiment of the present disclosure, as shown in FIGS. 3*a* and 3*b*, the common voltage adjusting circuit may further comprise an output subcircuit 03. A first input terminal of the output subcircuit 03 is electrically connected with the output terminal of the common voltage switching subcircuit 04 and the output terminal of the initial voltage subcircuit 05 respectively. A second input terminal thereof is electrically connected with the output terminal thereof. The output subcircuit 03 is used for performing current amplification of the common voltage signal Vcom outputted by the common voltage switching subcircuit 04 and the initial voltage subcircuit 05 and then outputting the common voltage signal Vcom.

In a driving circuit according to one embodiment of the present disclosure, as shown in FIG. 3*a* and FIG. 3*b*, the output subcircuit 03 may comprise an operational amplifier Y. A first input terminal of the operational amplifier Y is electrically connected with the output terminal of the initial voltage subcircuit 05 and the output terminal of the common voltage switching subcircuit 04 respectively. A second input terminal thereof is electrically connected with the output terminal thereof. The first input terminal of the operational amplifier is a positive input terminal. The second input terminal thereof is a negative input terminal. Acting as a follower, the operational amplifier is used for performing current amplification of the common voltage signal outputted from the output terminal of the initial voltage subcircuit and the output terminal of the common voltage switching subcircuit, thereby improving driving capability of the common voltage signal.

In a driving circuit according to one embodiment of the present disclosure, the common voltage adjusting circuit may comprise a plurality of common voltage switching subcircuits. Each of the common voltage switching subcircuits corresponds to a resolution. In both FIG. 3*a* and FIG. 3*b*, two switching subcircuits are illustrated as an example for description. In actual application, a display panel may switch to a plurality of resolutions according to actual need. Accordingly, a plurality of corresponding common voltage switching subcircuits may also be provided, and the number of switching subcircuits is not limited herein.

In one embodiment, in order to compensate for influence of the coupling voltage of pixels dVp on the common voltage Vcom caused by a change of a turn-on voltage signal VGH, the common voltage Vcom needs to be adjusted appropriately at the same time. The following is illustrated with the circuit structure of the common voltage adjusting circuit shown in FIG. 3*a*. The driving circuit according to one embodiment of the present disclosure can output a common voltage signal of the corresponding resolution of the display panel being switched to. The method specifically comprises the following steps:

In one embodiment, when both a 2K control signal and a 4 k control signal are at low level, switching transistors Q14 and Q12 are turned off, and switching transistors Q13 and Q11 are also turned off. The common voltage signal Vcom is controlled by resistor R15 and resistor R16 for voltage division. As such, a common voltage signal Vcom (Vcom_8 k) corresponding to 8K resolution can be outputted.

In one embodiment, when the 2K control signal is at low level and the 4 k control signal is at high level, switching transistors Q14 and Q13 are turned off and the switching transistors Q12 and Q11 are turned on. R5 and R7 are electrically connected in parallel. The common voltage signal Vcom is controlled by resistors R5 and R7 connected in parallel and then resistor R6 for voltage division. As such, a common voltage signal Vcom (Vcom_4 k) corresponding to a 4 K resolution can be outputted.

In one embodiment, when the 4K control signal is at low level and the 2K control signal is at high level, switching transistors Q11 and Q12 are turned off and the switching transistors Q13 and Q14 are turned on. Resistor R5 is electrically connected with resistor R9 in parallel. The common voltage signal Vcom is controlled by resistors R5 and R9 connected in parallel and then R6 for voltage division. As such, a common voltage signal Vcom (Vcom_2K) corresponding to a 2K resolution can be outputted.

In the driving circuit according to one embodiment of the present disclosure, dynamic real-time adjustment of a common voltage signal Vcom can be realized with operations of a combination of resistors and switching transistors. In one embodiment, the 2K control signal and the 4 k control signal can be provided by a display system or a timing controller (TCON)), Amplitudes of resistors R5, R6, R7, R8 and R9 and R10 can be determined based on requirement of a display panel for the common voltage Vcom, and are not limitation herein.

Figure 4:
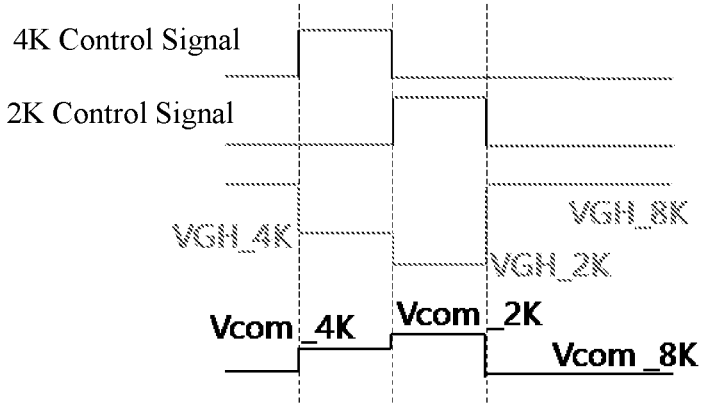
FIG. 4 is a timing diagram of a driving circuit for adjusting a turn-on voltage signal and a common voltage signal according to one embodiment of the present disclosure.

FIG. 4 is a timing diagram of a driving circuit for adjusting a turn-on voltage signal and a common voltage signal according to one embodiment of the present disclosure. Take switching among three resolutions for example, that is, switching among 8 k, 4 k and 2K resolutions, correspondingly, each of the initial level signal VGH and the common voltage signal Vcom can be adjusted to three different voltages respectively. Through selecting among three states 00, 10, and 01 of the 4K control signal and the 2K control signal, the signals can be switched, wherein 0 represents a low level and 1 represents a high level.

Table 1 shows reduction of power consumption of shift registers due to a decrease of an initial level signal VGH when a resolution of a display panel is reduced.

TABLE 1

| | 8K | 4K | 2K |
|---|---|---|---|
| Charging Time (us) | 1.85 | 3.7 | 7.4 |
| VGH (V) | 36 | 22 | 21 |
| Charging rate (%) | 98.3 | 98.3 | 98.3 |
| Power consumption of Shift registers (W) | 3.6 | 1.8 | 1.7 |

Another example of the present disclosure is a display panel. The display panel includes a driving circuit according to one embodiment of the present disclosure. The display panel may be a mobile phone, a flat computer, a television, a display, a notebook computer, a digital photo frame, a navigator and other products with display functions or parts. Since principle of the display panel solving the problem is similar to that of the driving circuit, an implementation of the display panel can be referred to the implementation of the drive circuit, and is not repeatedly described herein.

In a display panel according to one embodiment of the present disclosure, shift registers and voltage adjusting circuits may locate in peripheral area of the display panel. Switching transistors used in the circuits of the shift registers and the voltage adjusting circuits may be synchronously manufactured with switching transistors used for pixel switches of the display panel, thereby simplifying manufacturing process and reducing production cost.

Figure 5:
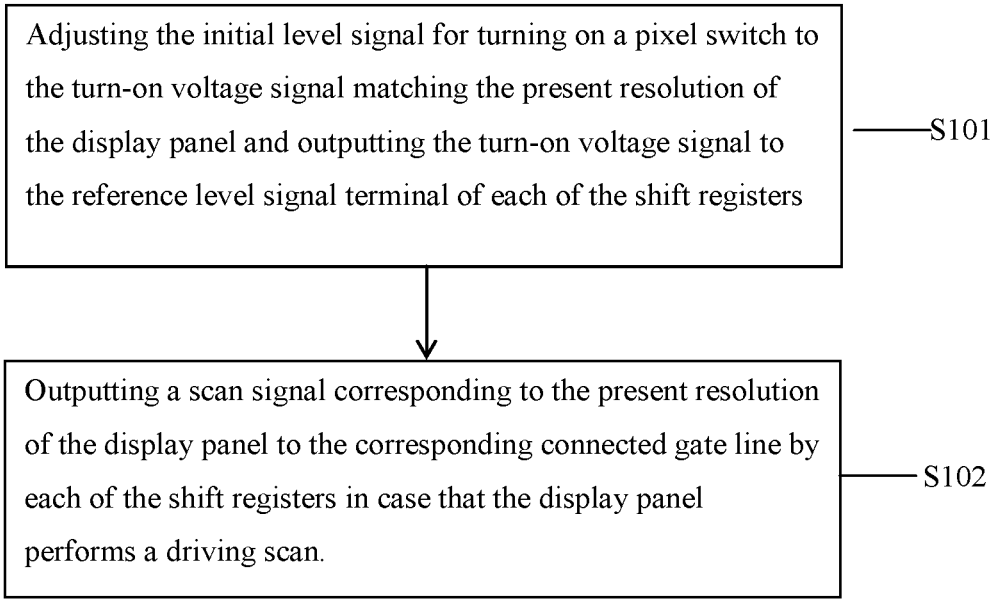
FIG. 5 is a flow chart of a driving method according to one embodiment of the present disclosure.

FIG. 5 is a driving method for the driving circuit according to one embodiment of the present disclosure. The method includes the following steps:

In step S101, based on a present resolution of a display panel being switched to, an initial level signal for turning on a pixel switch is adjusted to an turn-on voltage signal matching the present resolution of the display panel, and the turn-on voltage signal is outputted to a reference level signal terminal of each of the shift registers.

In step S102, when the display panel performs a driving scan, based on the signal from the reference level signal terminal, each of the shift registers inputs a scan signal corresponding to the present resolution of the display panel to a correspondingly connected gate line.

In the driving method according to one embodiment of the present disclosure, when a display resolution of the display panel is switched, the turn-on voltage for the pixel switch is adjusted at the same time, thereby decreasing driving voltages and power consumption of the shifting registers.

A driving circuit for a display panel, a driving method thereof and a display panel are provided according to one embodiment of the present disclosure. The driving circuit comprises a turn-on voltage adjusting circuit and a plurality of cascaded shifting registers. The turn-on voltage adjusting circuit is used for adjusting an initial level signal for turning on a pixel switch to a turn-on voltage signal matching the present resolution of the display panel and outputting the turn-on voltage signal to a reference level signal terminal of each of the shift registers. Based on the signal from the reference level signal terminal, each of the shifting registers is used to input a scan signal corresponding to the present resolution of the display panel to a correspondingly connected gate line when the display panel performs a driving scan. In this way, by arranging a turn-on voltage adjusting circuit in the driving circuit, when a display panel switches between different display resolutions, a turn-on voltage for the pixel switch is adjusted at the same time. As such, a driving voltage and power consumption of the shifting registers can be reduced. When a display panel switches to a lower resolution, charging time for the pixels is prolonged, so that charging current can be reduced. Thus, satisfying the same charging rate as a reference, a turn-on voltage for the pixel switch, that is, a voltage of a scan signal outputted by the shift register, is properly reduced, thereby reducing power consumption of the shift registers as well as power consumption of the display panel.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A driving circuit of a display panel, comprising:

a turn-on voltage adjusting circuit, the turn-on voltage adjusting circuit comprising:

a control subcircuit; and a switching and voltage division subcircuit; the switching and voltage division sub circuit comprising:

a switching subcircuit; and a basic voltage division subcircuit;

wherein the switching subcircuit includes a control terminal, a first input terminal, a second input terminal and an output terminal; the control terminal of the switching subcircuit is configured to input a control signal of a corresponding resolution, the first input terminal thereof is electrically connected with an output terminal of the control subcircuit, the second input terminal is configured to access a ground power supply signal, and the output terminal thereof is electrically connected with a voltage division feedback node; and the switching subcircuit is configured to perform voltage division of a signal outputted by the output terminal of the control subcircuit to form a voltage division feedback signal of the corresponding resolution under control of the control signal and output the voltage division feedback signal to the voltage division feedback node; and wherein the control subcircuit includes a first input terminal, a second input terminal and the output terminal, the first input terminal of the control subcircuit is electrically connected with the voltage division feedback node, the second input terminal thereof is configured to input an initial level signal, and the output terminal thereof is electrically connected with the first input terminal of the switching and voltage division subcircuit and is configured to output an turn-on voltage signal of the corresponding resolution.

2. The driving circuit according to claim 1, further comprising a plurality of cascaded shift registers, wherein the turn-on voltage adjusting circuit is configured to adjust the initial level signal for turning on a pixel switch to a turn-on voltage signal matching a present resolution of the display panel, and output the turn-on voltage signal to a reference level signal terminal of each of the plurality of the cascaded shift registers; and each of the plurality of the cascaded shift registers is configured to input a scan signal corresponding to the present resolution of the display panel to a correspondingly connected gate line based on the turn-on voltage signal at the reference level signal terminal in case that the display panel performs a driving scan.

3. The driving circuit according to claim 1, wherein the switching subcircuit comprises:

a third resistor;

a fourth resistor;

a first switching transistor; and a second switching transistor;

wherein one terminal of the third resistor is electrically connected with one terminal of the fourth resistor and configured to access the signal outputted by the output terminal of the control subcircuit, the other terminal of the third resistor is electrically connected with a source electrode of the first switching transistor;

a gate electrode of the first switching transistor is respectively electrically connected with the other terminal of the fourth resistor and a drain electrode of the second switching transistor, a drain electrode of the first switching transistor is electrically connected with the voltage division feedback node; and a gate of the second switching transistor is configured to input the control signal of the corresponding resolution, and a source of the second switching transistor is configured to access the ground power supply signal.

4. The driving circuit according to claim 1, wherein the switching subcircuit comprises:

a first voltage division resistor; and a fifth switching transistor;

wherein one terminal of the first voltage division resistor is configured to access the signal outputted by the output terminal of the control subcircuit, the other terminal thereof is electrically connected with a source electrode of the fifth switching transistor; and a gate electrode of the fifth switching transistor is configured to input the control signal of the corresponding resolution, and a drain electrode thereof is electrically connected with the voltage division feedback node.

5. The driving circuit according to claim 1, wherein the basic voltage division subcircuit comprises:

a first resistor; and a second resistor;

wherein one terminal of the first resistor is configured to access the signal outputted by the output terminal of the control subcircuit, and the other terminal thereof is electrically connected with the voltage division feedback node; and one terminal of the second resistor is electrically connected with the voltage division feedback node, and the other terminal thereof is configured to access the ground power supply signal.

6. The driving circuit according to claim 1, wherein the control subcircuit comprises a voltage division feedback processing subcircuit; and a voltage regulation subcircuit;

a first control terminal of the voltage division feedback processing subcircuit is configured to input a pulse control signal, a second control terminal thereof is configured to input a reference signal, a first input terminal thereof is configured to input the initial level signal, a second input terminal thereof is electrically connected with the voltage division feedback node, an output terminal thereof is electrically connected with an input terminal of the voltage regulation subcircuit; and under control of the pulse control signal, the reference signal, and the voltage division feedback signal, the voltage division feedback processing subcircuit is configured to perform feedback of the initial level signal to form a corresponding coupling charging signal and output the corresponding coupling charging signal to the first input terminal of the voltage regulation subcircuit; and a second input terminal of the voltage regulation subcircuit is configured to input the initial level signal, an output terminal thereof is configured to output the turn-on voltage signal after voltage regulation; and the voltage regulation subcircuit is configured to perform voltage regulation of the initial level signal based on the coupling charging signal to form the turn-on voltage signal of the corresponding resolution and output the turn-on voltage signal.

7. The driving circuit according to claim 1, wherein the turn-on voltage adjusting circuit comprises a plurality of switching subcircuits, and each of the plurality of switching subcircuits corresponds to a different resolution.

8. The driving circuit according to claim 1, further comprising a common voltage adjusting circuit;

wherein the common voltage adjusting circuit is configured to adjust a power supply signal for providing a common voltage to a common voltage signal matching the corresponding resolution of the display panel and output the common voltage signal.

9. The driving circuit according to claim 8, wherein the common voltage adjusting circuit comprises a common voltage switching subcircuit;

wherein a control terminal of the common voltage switching subcircuit is configured to input a switching control signal corresponding to the present resolution, a first input terminal thereof is configured to access the power supply signal, a second input terminal thereof is configured to connect with the ground power supply signal, an output terminal thereof is configured to output the common voltage signal of the corresponding resolution, and under control of the switching control signal, the common voltage switching subcircuit is configured to adjust the power supply signal to the common voltage signal of the corresponding resolution and output the common voltage signal.

10. The driving circuit according to claim 9, wherein the common voltage switching subcircuit comprises:

a seventh resistor, an eighth resistor, a third switching transistor, and a fourth switching transistor;

wherein one terminal of the seventh resistor is configured to access the power supply signal, the other terminal thereof is electrically connected with a source electrode of the third switching transistor;

a gate electrode of the third switching transistor is respectively electrically connected with one terminal of the eighth resistor and a drain electrode of the fourth switching transistor; a drain electrode thereof is configured to output the common voltage signal of the corresponding resolution, the other terminal of the eighth resistor is configured to access the power supply signal, a gate electrode of the fourth switching transistor is configured to input the switching control signal of the corresponding resolution, and a source electrode thereof is electrically connected with the ground power supply signal.

11. The driving circuit according to claim 9, wherein the common voltage switching subcircuit comprises a second division resistor and a sixteenth switching transistor;

wherein the second voltage division resistor is configured to access the power supply signal, the other terminal thereof is electrically connected with a source electrode of the sixteenth switching transistor; and a gate electrode of the sixteenth switching transistor is configured to input the switching control signal of the corresponding resolution, a drain electrode thereof is configured to output the common voltage signal of the corresponding resolution.

12. The driving circuit according to claim 8, wherein the common voltage adjusting circuit further comprises an initial voltage subcircuit;

wherein a first input terminal of the initial voltage subcircuit is configured to access the power supply signal, a second input terminal thereof is electrically connected with the ground power supply signal, an output terminal thereof is configured to output the common voltage signal of the corresponding resolution, and the initial voltage subcircuit is configured to perform voltage division of the power supply signal and output the common voltage signal of the corresponding resolution.

13. The driving circuit according to claim 12, wherein the initial voltage subcircuit comprises a fifteenth resistor and a sixteenth resistor;

wherein a first terminal of the fifteenth resistor is configured to access the power supply signal, the other terminal thereof is electrically connected with one terminal of the sixteenth resistor and configured to output the common voltage signal of the corresponding resolution, and the other terminal of the sixteenth resistor is configured to access the ground power supply signal.

14. The driving circuit according to claim 12, wherein the common voltage adjusting circuit further comprises an output subcircuit;

a first input terminal of the output subcircuit is respectively electrically connected with the output terminal of the common voltage switching subcircuit and the output terminal of the initial voltage subcircuit, the second input terminal thereof is electrically connected with the output terminal thereof, the output subcircuit is configured to perform current amplification of the common voltage signal outputted by the common voltage switching subcircuit and the initial voltage subcircuit and then output an amplified common voltage signal.

15. The driving circuit according to claim 14, wherein the output subcircuit comprises an operational amplifier;

a first input terminal of the operational amplifier is electrically connected with the output terminal of the initial voltage subcircuit and the output terminal of the common voltage switching subcircuit respectively, and a second input terminal thereof is electrically connected with the output terminal thereof.

16. The driving circuit according to claim 8, wherein the common voltage adjusting circuit comprises a plurality of common voltage switching subcircuits, each of the common voltage switching subcircuits corresponds to a different resolution.

17. A display panel comprising the driving circuit according to claim 1.

18. The display panel according to claim 17, wherein shifting registers and the voltage adjusting circuit are located at peripheral area of the display panel.

19. A driving method for the driving circuit according to claim 1, comprising:

providing the initial level signal to the second input terminal of the control subcircuit and providing the control signal of the corresponding resolution of the display panel to the switching subcircuit so that the turn-on voltage signal matching the corresponding resolution of the display panel is outputted from the turn-on voltage adjusting circuit to a reference level signal terminal of each of shift registers.

* * * * *